US007363990B2

(12) United States Patent
Arzberger

(10) Patent No.: US 7,363,990 B2
(45) Date of Patent: Apr. 29, 2008

(54) CUTTING DEVICE AND METHOD FOR PRODUCING A CUT HOLE

(75) Inventor: Maximilian Michael Arzberger, Igenhausen (DE)

(73) Assignee: Bauer Maschinen GmbH, Schrobenhausen (DE)

( * ) Notice: Subject to any disclaimer, the term of this patent is extended or adjusted under 35 U.S.C. 154(b) by 101 days.

(21) Appl. No.: 11/189,815

(22) Filed: Jul. 27, 2005

(65) Prior Publication Data

US 2006/0032671 A1 Feb. 16, 2006

(30) Foreign Application Priority Data

Aug. 10, 2004 (EP) ..... 04018932

(51) Int. Cl.
*E21B 7/00* (2006.01)

(52) U.S. Cl. ..... 175/57; 175/96

(58) Field of Classification Search ..... 175/57, 175/91, 94, 96; 37/94, 189
See application file for complete search history.

(56) References Cited

U.S. PATENT DOCUMENTS 4,629,010 A 12/1986 Sourice
4,904,119 A 2/1990 Legendre et al.

FOREIGN PATENT DOCUMENTS

EP 0735199 A1 10/1996
EP 0819819 B1 1/1998
JP 06116959 4/1994

*Primary Examiner*—Giovanna C. Wright
(74) *Attorney, Agent, or Firm*—Jacobson Holman PLLC

(57) ABSTRACT

A cutting device for sinking a cut hole in the ground, having a support on which are mounted in rotary manner about in each case one cutting wheel rotation axis at least two cutting wheels, at least one cutting wheel drive mechanism for the rotary driving of the cutting wheels on the support and a drive mechanism for the rotary driving of the support together with the cutting wheels about a support rotation axis directed roughly parallel to the sinking direction. A method for producing a cut hole in the ground using the cutting device.

21 Claims, 6 Drawing Sheets

CUTTING DEVICE AND METHOD FOR PRODUCING A CUT HOLE

BACKGROUND OF THE INVENTION

1. Field of the Invention

The invention relates to a cutting device for sinking a cut hole into the ground. The invention also relates to a method for producing a cut hole in the ground.

A cutting fixture of this type has a support on which is mounted so as to rotate about in each case one cutting wheel rotation axis at least two cutting wheels, as well as at least one cutting wheel drive mechanism for the rotary driving of the cutting wheels on the support. In a method of the present type, at least two cutting wheels mounted in rotary manner on a support are rotated about in each case one cutting wheel rotation axis by means of a cutting wheel drive mechanism, and the support with the cutting wheels is advanced in a sinking direction in the ground.

2. Related Art

For producing cut holes having a rectangular cut hole cross-section EP 635 199 B1 e.g. discloses trench wall cutters. Such trench wall cutters have two offset cutting wheel pairs which rotate in opposition on parallel, horizontal shafts. Soil is stripped at the cutting wheels and conveyed into a gap between the two wheels, from where it is transported upwards by means of a suction device.

A cutting head and a method for producing cut holes with a round cut hole cross-section in the ground are known from EP 819 819 B1. The cutting head known from EP 819 819 B1 has four cutting wheels, which are arranged in rotary manner about a common cutting wheel axis, which is directed radially to the cutting head sinking direction. For the formation of a round cutting head cross-section, starting from the centre of the cutting head, the diameter of the cutting wheels narrows in the axial direction of the common cutting wheel axis.

SUMMARY OF THE INVENTION

The object of the invention is to provide a cutting device and a method for producing a cut hole in the ground with which it is possible to produce cut holes in the most varied soil geologies in a particularly universal and economic manner.

According to the invention this object is achieved by a cutting device having a support on which are mounted in rotary manner about in each case one cutting wheel rotation axis, at least two cutting wheels and at least one cutting wheel drive mechanism for the rotary driving of the cutting wheels on the support, wherein a drive mechanism for the rotary driving of the support together with the cutting wheel about a support rotation axis is provided and is directed roughly parallel to the sinking direction (T); and a method for producing a cut hole in the ground in which at least two cutting wheels mounted in rotary manner on a support are rotated about in each case one cutting wheel rotation axis by means of a cutting wheel drive mechanism, and the support with the cutting wheels is advanced in a sinking direction (T) in the ground, wherein the support together with the cutting wheels is simultaneously rotated by means of a drive mechanism about a support rotation axis, which is directed roughly parallel to the sinking direction (T).

A cutting device according to the invention is characterized in that there is a drive mechanism for the rotary driving of the support together with the cutting wheels about a support rotation axis directed roughly parallel to the sinking direction.

A first fundamental idea of the invention is a drive mechanism with which it is possible to rotate the support together with the at least two cutting wheels. By means of the drive mechanism it is possible to vary the relative position of the cutting wheels with respect to the ground. Particularly by rotating the support together with the cutting wheels about the support rotation axis it is possible to produce a cut hole with a round cut hole cross-section without it being necessary for the cutting wheels to have a round cross-section, i.e. a narrowing diameter. Thus, for obtaining a good cutting advance particularly suitable cutting wheel shapes can be chosen and e.g. a roughly rectangular cutting wheel cross-section can also be provided.

The cutting device can in particular be designed in such a way that on rotating the support by means of the drive mechanism in each case only roughly a quarter of the total circumference of the cutting wheels is in engagement with the outcropping soil material. Thus, the cutting device according to the invention can be referred to as a partial cut cutting device, in which the maximum dimensions of the cutting wheels are smaller than the cross-section of the cut hole. As opposed to full cut cutting devices, in which roughly half or more of the cutting wheel circumference acts on the outcropping soil, in the case of the cutting device according to the invention there is a smaller contact surface with the outcropping soil and therefore for obtaining the same contact pressure of the cutting wheels on the cut hole bottom a correspondingly lower contact force in the sinking direction is required. This makes it possible to produce cut holes with a comparatively lower superimposed load, so that the inventive cutting device can be particularly easily and economically operated. With a cutting device according to the invention the contact pressure can remain substantially constant, particularly even when changing the cut hole diameter and/or the cutting wheel diameter.

The cutting device according to the invention is particularly suitable for producing foundation elements, especially piles, in the ground and can therefore also be called a pile cutter. Preferably the inventive cutting device enables the foundation elements to be tied into rocky soils.

The sinking direction in the sense of the present invention can in particular be the direction in which the support with the cutting wheels are advanced on sinking the cut hole, i.e. the longitudinal direction of the cut hole to be produced. According to the invention the support rotation axis runs in said sinking direction and forms the cut hole longitudinal axis. A cutting device particularly suitable for absorbing the forces arising during cutting operation can be obtained in that the cutting wheels and/or the cutting wheel rotation axes are symmetrical to the support rotation axis. With regard to the absorption of forces it is also advantageous that the angles between the cutting wheel rotation axes and the support rotation axis are approximately 90°. However, other angles down to 0° can be provided. The cutting wheel rotation axis can fundamentally intersect the support rotation axis, particularly radially. However, the cutting wheel rotation axes can also be positioned with an offset or displacement with respect to the support rotation axis, which makes it possible to obtain particularly large cut hole diameters.

In a preferred further development of a cutting device according to the invention a pivoting device is provided with which at least one of the cutting wheels is pivotable, particularly upwardly pivotable on the support. Pivoting can in particular be understood as a change to the angle between the cutting wheel rotation axis of the at least one cutting wheel and the support rotation axis. Through the pivoting of the at least one cutting wheel it is possible to modify an outer application point of said cutting wheel on the outcropping soil with respect to the support and/or the support rotation axis and consequently the instantaneous cutting radius can be varied. In particular, the at least one cutting wheel can be pivoted in depth-dependent manner and consequently a cut hole is obtained, whose diameter varies over the depth. As a result e.g. cut holes can be produced, which are widened at the bottom of the cut hole for forming a pile base. Optionally by a planned cut hole base-side widening of the cut hole, it is possible to produce sealing elements, particularly sole elements. As a result of the pivotable arrangement of at least one of the cutting wheels, in the case of a particularly compact construction of the cutting fixture a particularly large working area can be covered. The pivoting device advantageously has a bearing device by means of which the at least one cutting wheel is pivotably mounted about a horizontal axis. Appropriately the pivoting device has in addition a pivoting drive, particularly with at least one hydraulic pivoting cylinder, for the driven pivoting of the at least one cutting wheel. In order to obtain a symmetrical distribution of forces on the support and therefore a particularly robust cutting device, it is advantageous for both cutting wheels to be pivotable on the support, pivoting appropriately taking place simultaneously and preferably about a common horizontal pivoting axis. Pivoting up can in particular be understood to mean that the at least one cutting wheel is raised with respect to the cut hole bottom during pivoting.

A particularly appropriate further development of the inventive cutting device is characterized in that the support is terminally positioned on a tube linkage. This tube linkage, which can in particular extend to a construction implement located outside the cut hole, can be used for the transmission of superimposed load forces, i.e. press forces to the support with the cutting wheels. However, the cutting fixture can e.g. be suspended on a supporting cable. A particularly universally usable cutting device is obtained in that the support is pivotable with respect to the tube linkage by means of a pivoting drive.

Any drifting of the cutting device during its operation can be inventively effectively reduced in that on the support and/or on the tube linkage is provided a guide mechanism, particularly a guide ring, for supporting the support or tube linkage on a hole wall. Optionally there can also be several guide mechanisms on the support and/or tube linkage in superimposed manner, which leads to a guidance in several planes. The guide mechanism appropriately has guide shoes, which are provided for contacting the wall of the cut hole and are connected to the support and/or tube linkage by struts running radially to the support rotation axis. Advantageously the guide shoes are constructed in the form of a guide ring, which can also be constructed in interrupted manner. If the cut hole is produced through the introduction of a support tube, the guide mechanism can also be provided for supporting purposes on said support tube.

More particularly if the cutting device is constructed for producing cut holes with a variable cut hole diameter, it can be advantageous to construct the guide mechanism in diameter-adjustable manner. For this purpose can e.g. be provided an adjusting device, with which it is possible to vary the length of the struts on which the guide shoes are located. If a guide ring is provided, it can have a segmental construction for diameter adjustment purposes.

A particularly precise guidance of the cutting device according to the invention on sinking the cut hole can be brought about in that a clamping or tensioning device is provided for fixing the tube linkage in a support tube and the tube linkage is axially extendible for driving the support. As a result the tube linkage can be kept particularly short and therefore a drifting of the cutting device is effectively reduced. Appropriately hydraulic pressure cylinders are provided for axially lengthening the tube linkage. In this preferred embodiment the press force is at least partly applied by the pressure cylinder. However, the weight of the cutting device may in itself be adequate to ensure a sufficient contact pressure.

It is particularly preferred according to the invention that the drive mechanism is positioned between the tube linkage and the support and/or in an upper area of the tube linkage. If the drive mechanism is located in the upper area, this can advantageously be outside the cut hole, particularly on a construction implement. The drive mechanism and/or the cutting wheel drive mechanism appropriately have hydraulic motors. The drive mechanism and cutting wheel mechanism can also be constructed with a common motor. The cutting wheel drive mechanism can e.g. be provided on the support, but also on the upper area of the tube linkage.

A particularly preferred development of an inventive cutting device is characterized in that the cutting wheel rotation axis of at least one cutting wheel has an offset relative to the support rotation axis and that in particular a cutting wheel offset drive is provided for modifying the offset. As a result of the offset of the at least one cutting wheel, its application point to the outcropping soil material is radially outwardly displaced with respect to the support rotation axis, so that the cutting cross-section is increased for the same cutting wheel diameter. It is particularly advantageous from the force symmetrical standpoint that both cutting wheels are located with the same offset or displacement with respect to the support rotation axis. Advantageously the cutting wheel rotation axes are forwardly displaced in the support rotation direction with respect to the support rotation axis. The cutting wheel offset drive makes it possible to modify the offset, in particular during sinking of the cutting device, so as to permit the production of a cut hole with a variable diameter. Appropriately the cutting wheel offset drive is constructed for the simultaneous and homogeneous modification of the offset of all the cutting wheel rotation axes.

A cutting device with a particularly good cutting advance can be inventively obtained in that the cutting wheels are constructed as cutting wheel pairs with in each case two individual cutting wheels and that the individual cutting wheels of the cutting wheel pairs are in each case mounted on a bearing bracket pivotably mounted on the support. A constructionally particularly simple cutting device can be obtained in that the two individual cutting wheels of each cutting wheel pair have in each case an identical rotation axis. Advantageously each cutting wheel pair has its own cutting wheel drive motor, which can in particular be provided on a common bearing bracket. It is particularly preferred for all the bearing brackets to be pivotably mounted about a common horizontal pivoting axis.

A particularly good cutting advance can also be inventively obtained in that the cutting wheels are circumferentially and/or frontally provided with cutting tools. The cutting tools can e.g. be constructed as cutting teeth or cutting rolls. A frontal arrangement of the cutting tools is particularly advantageous if the cutting wheels are positioned pivotably on the support, because during pivoting and during the sinking of the cutting device the cutting wheels can engage frontally with the outcropping soil material. The cutting wheels are appropriately at least approximately cylindrical and between the circumferential surface, which can also be referred to as a cylinder jacket, and the front face there is advantageously a bevelled intermediate area. The cutting wheels are appropriately rotated in the same or opposite directions so that the cleared soil material is supplied to a suction opening of a pump located on the support. The cutting wheels, particularly the individual cutting wheels, can be advantageously replaceably provided on the support. Thus, the cutting wheels can e.g. be replaced by cutting wheels having different diameters and therefore the cut hole diameter can be modified. The cutting wheels can also be replaced by wheels with different cutting tools, if a different soil or ground geology is encountered during the cutting process. Thus by replacing the cutting wheels it is possible to produce cut holes with a particularly large diameter and which can be tied into the rock.

The method according to the invention is characterized in that the support, together with the cutting wheels, are simultaneously rotated by means of a drive mechanism about a support rotation axis, which is directed roughly parallel to the sinking direction. When performing the method according to the invention use can in particular be made of the cutting device according to the invention, so that the advantages explained in conjunction with the cutting device can be obtained.

Fundamentally it is inventively possible to rotate the support whilst constantly maintaining the rotation direction about the support rotation axis. However it is preferable for the rotation direction of the support about the support rotation axis to be changed in alternating manner. It is advantageous for a particularly rapid production of the cut hole for the rotation axis to be changed in each case after covering a rotation angle of approximately 180°.

A particularly preferred development of the inventive method is characterized in that at least one of the cutting wheels is pivoted and in particular pivoted up on the support, particularly as a function of the rotation angle of the support round the support rotation axis. Through the pivoting of the at least one cutting wheel it is possible to instantaneously modify the excavation radius of the cutting wheel and therefore vary the cutting hole diameter in cut hole depth-dependent manner. This e.g. makes it possible to produce undercut pile bores, which are in particular widened in the base area. The rotation angle-dependent pivoting of the cutting wheel also makes it possible to produce cut holes with round cut hole cross-sections which differ from a circular shape. It is in particular possible to produce cut holes and foundation piles with an elliptical cross-section, which can lead to a material saving in the case of large pile diameters and corresponding ground plan shapes. It is particularly advantageous if both cutting wheels are simultaneously and symmetrically pivoted. The simultaneous pivoting movement of both cutting wheels can also be referred to as spreading. Whereas the drive mechanism can provide an adjustability of the cutting wheels about a vertical axis, the pivoting device provides an adjustment possibility about a horizontal axis. By superimposing the two adjustment possibilities the cut hole cross-section can be varied in a particularly universal manner.

BRIEF DESCRIPTION OF THE DRAWINGS

The invention is described in greater detail hereinafter relative to preferred embodiments and the attached diagrammatic drawings, wherein show.

DETAILED DESCRIPTION OF THE PREFERRED EMBODIMENTS

Figure 1:
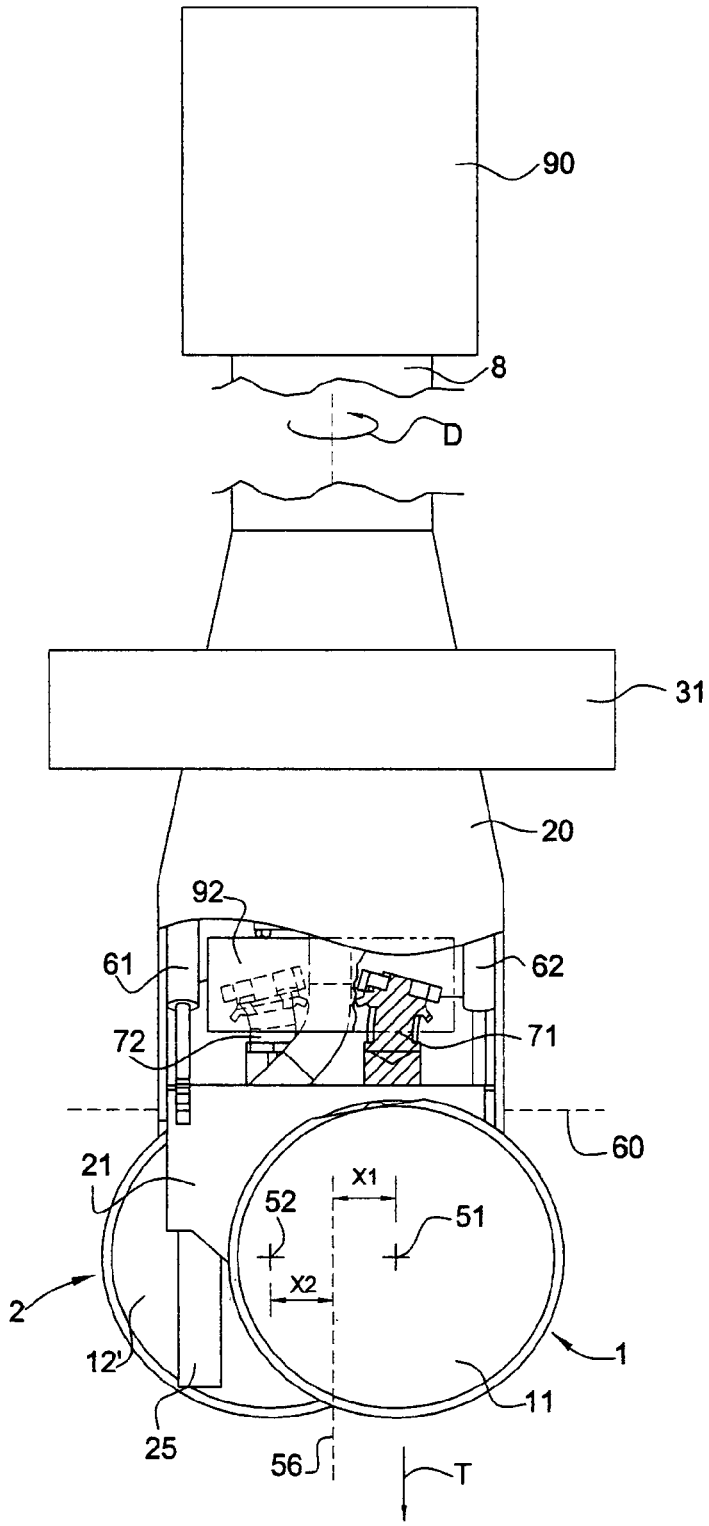
FIG. 1A part sectional side view of a cutting device according to the invention.
Figure 2:
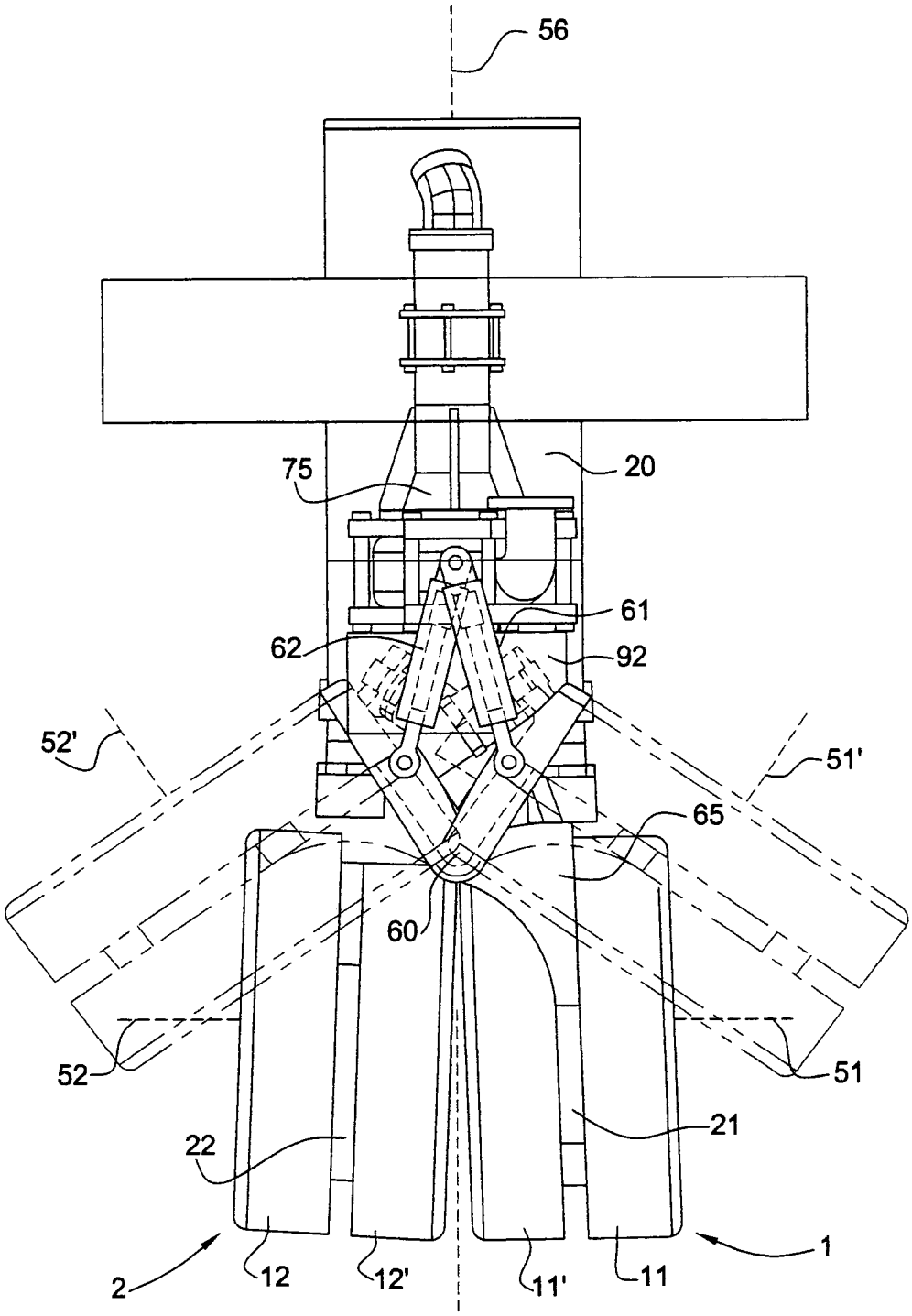
FIG. 2 A front view of the cutting device of FIG. 1, in which the cutting wheels are shown in the unpivoted state using a continuous line and in the pivoted up state with a broken line.
Figure 3:
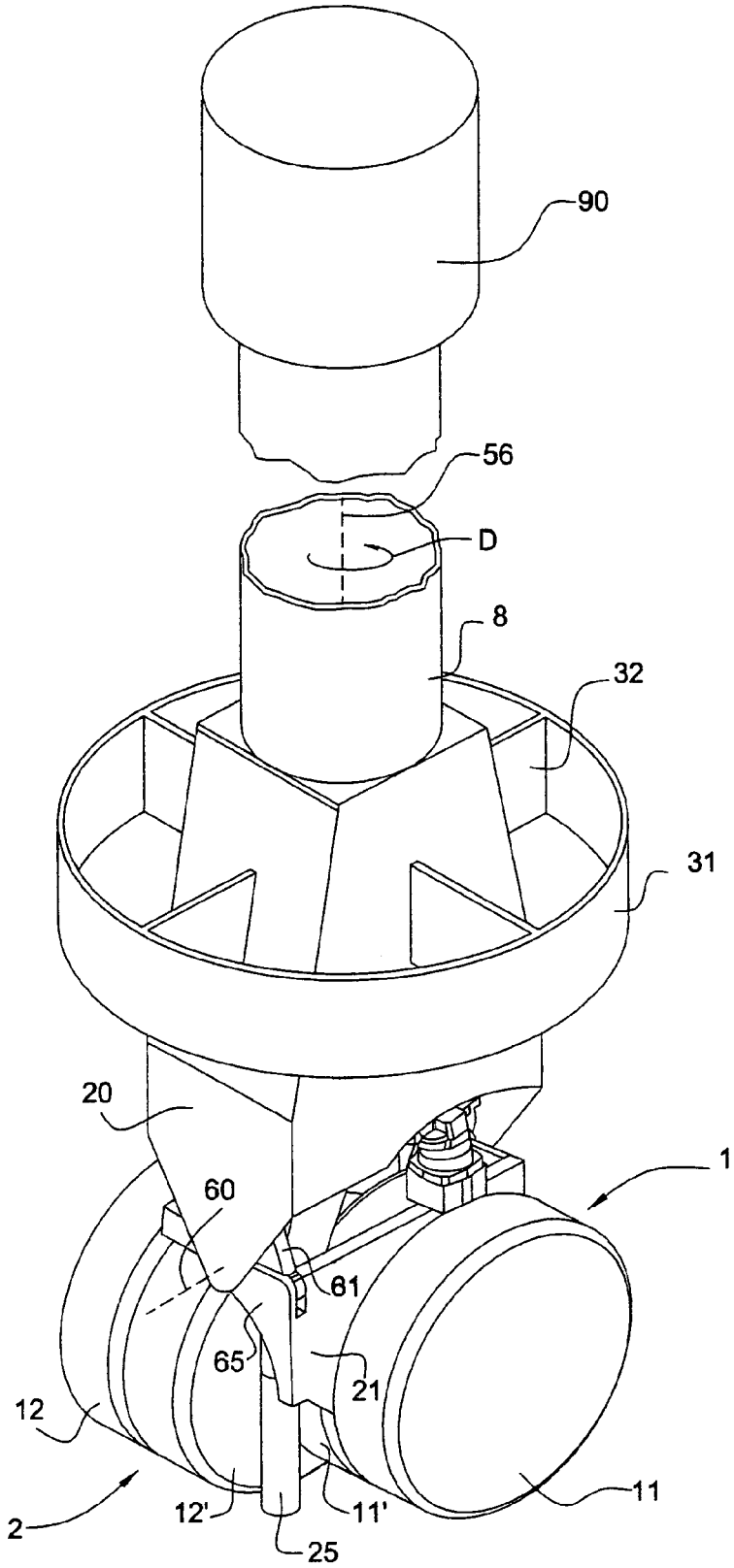
FIG. 3 A perspective view of the cutting device of FIG. 1 with unpivoted cutting wheels.
Figure 4:
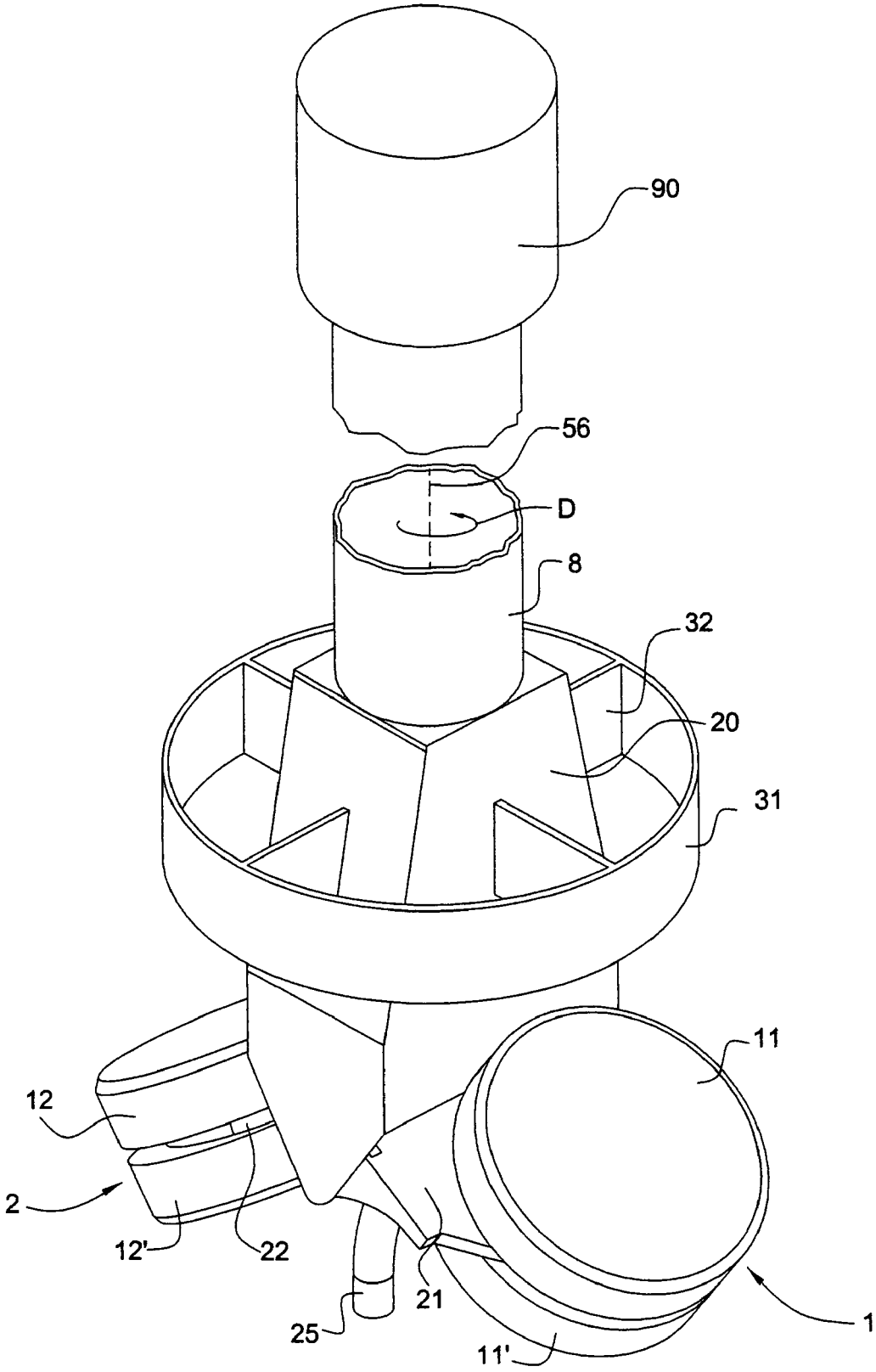
FIG. 4 A perspective view of the cutting device of FIG. 1 with pivoted up cutting wheels.
Figure 5:
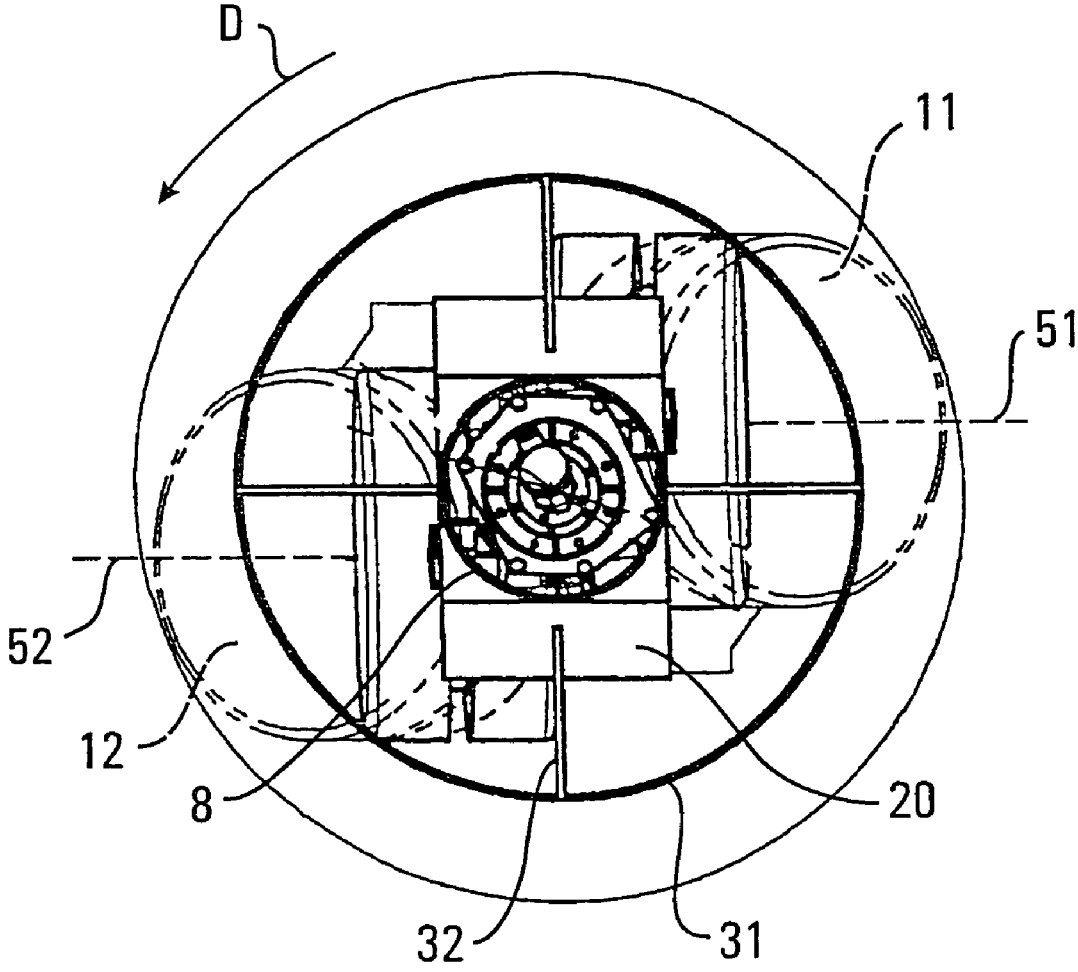
FIG. 5 A plan view of the cutting device of FIG. 1, in which the cutting wheels are shown in the unpivoted state with a continuous line and in the pivoted up state with a broken line.

A cutting device according to the invention is shown in FIGS. 1 to 5. The cutting device has a support 20 constructed as a frame on the bottom of which two cutting wheels 1, 2 are mounted so as to rotate about cutting wheel rotation axes 51, 52. The cutting wheels 1, 2 are constructed as cutting wheel pairs, the cutting wheel 1 having two individual cutting wheels 11, 11' and the cutting wheel 2 two individual cutting wheels 12, 12'. The individual cutting wheels 11, 11' are mounted on either side of a bearing bracket 21 and the individual cutting wheels 12, 12' on either side of a further bearing bracket 22. For the rotary driving of the cutting wheels 1, 2 is provided a cutting wheel drive mechanism 92 with two hydraulic rotation motors 71, 72, which are located at the top side of bearing brackets 21, 22 respectively. Further a drive unit constructed as a pump mechanism 75 is provided on support 20.

The support 20 is fixed in non-rotatable manner at the lower end of a tube linkage 8. By means of a drive mechanism 90 the tube linkage 8 and therefore the support 20 can be rotated in rotation direction D about the support rotation axis 56. The cutting wheels 1, 2, which are driven in rotation about cutting wheel axes 51, 52, describe a circular path on which they remove soil material. Simultaneously with the rotary movement about the support rotation axis 56, the support 20 is advanced in the sinking direction T. This advance can occur solely as a result of the weight of the cutting device or as a result of an advance drive, which exerts a superimposed load force on the tube linkage 8. Support and/or cutting liquid can be introduce into and/or removed from the cut hole during the cutting process by means of a supply opening 25 provided on the frame 20 between the cutting wheels 1, 2.

The support rotation axis 56 runs centrally in the tube linkage 8 in the sinking direction T. It forms the longitudinal axis of a cut hole with a circular cross-section produced during the rotation of support 20. The cutting wheels 1, 2 are located symmetrical to the support rotation axis 56. In the unpivoted state of the cutting wheels 1, 2 their cutting wheel rotation axes 51, 52 are parallel to one another and form an angle of approximately 90° with the support rotation axis 56. The cutting wheels 1, 2 with their cutting wheel rotation axes 51, 52 are located in advance of the support rotation axis 56 in rotation direction D in such a way that the cutting wheel rotation axis 51 has an offset X1 relative to the support rotation axis 56 and the cutting wheel rotation axis 52 is spaced with an offset X2 from the support rotation axis 56, the offset X1 being equal to the offset X2. This can in particular be gathered from FIGS. 1 and 5.

For increasing the cutting cross-section the cutting wheels 1, 2 on support 20 are pivotably mounted about a common horizontal pivoting axis 60. For this purpose the bearing brackets 21, 22 are articulated to support 20 by means of lateral, L-shaped lever arms 65. For the driven pivoting of the cutting wheels 1, 2 is provided a pivoting device with two hydraulic cylinders 61, 62, which are articulated by one end to support 20 and by the other end to the bearing brackets 21, 22 respectively. By shortening said hydraulic cylinders 61, 62 the lever arms 65 with the bearing brackets 21, 22 and the individual cutting wheels 11, 11', 12, 12' are pivoted upwards about the common pivoting axis 60. In this pivoted state, represented in broken lines in FIGS. 4, 2 and 5, the cutting wheel rotation axes 51', 52' form an angle differing from 90° with the support rotation axis 56. The pivoting of the cutting wheels 1, 2, which can fundamentally take place in stepless manner, can in particular be continued until the cutting wheel rotation axes 51', 52' are parallel to the support rotation axis 56.

For guiding the support 20 in the cut hole on said support 20 is provided a guide ring 31 making use of four struts 32 running radially to the support rotation axis 56. The support 20 can be supported on the cut hole wall by means of said guide ring 31 which is coaxial to the support rotation axis 56.

A particularly precise guidance of the cutting device according to the invention on sinking the cut hole can be brought about in that a clamping or tensioning device 96 is provided for fixing the tube linkage 8 in a support tube 94 and the tube linkage 8 is axially extendible for driving the support 20.

Figure 6:
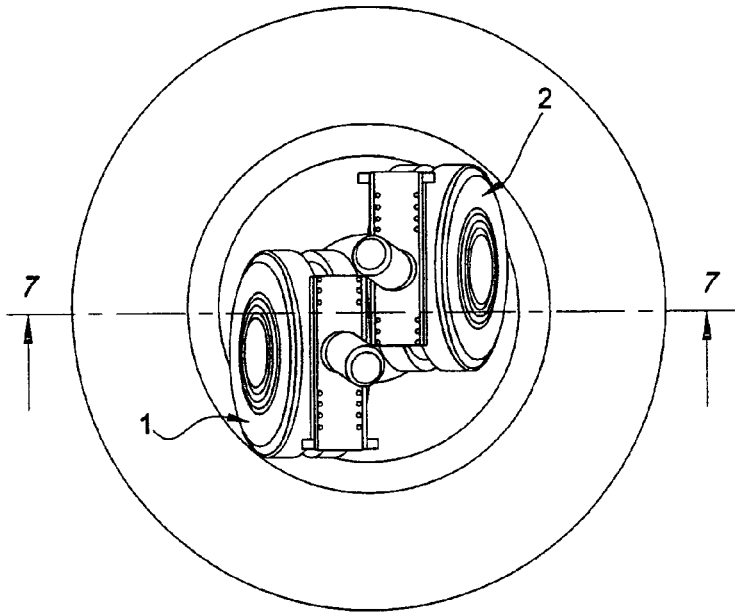
FIG. 6 A plan view of the horizontally pivoted cutting wheels of a second embodiment of an inventive cutting device.
Figure 7:
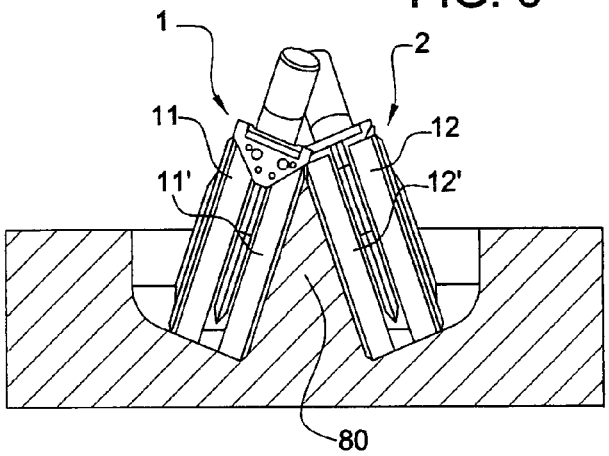
FIG. 7 A sectional view 7-7 of the cutting wheels of FIG. 6.
Figure 8:
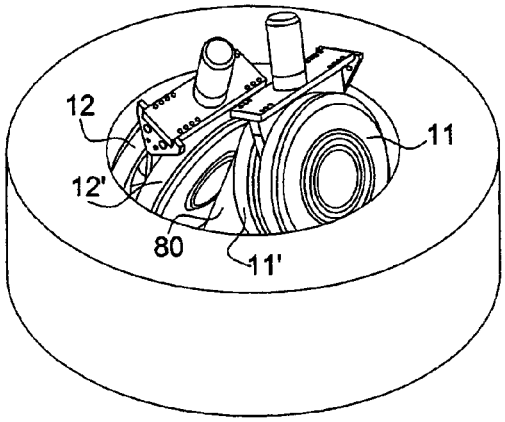
FIG. 8 A perspective view of the cutting wheels of FIG. 6.
Figure 9:
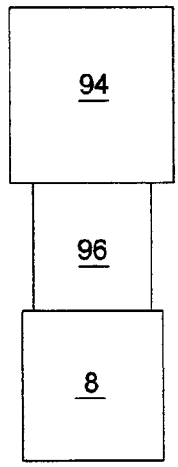
FIG. 9 A diagrammatic illustration of the clamping or tensioning device provided for fixing the tube linkage in a support tube.

FIGS. 6 to 8 show a cutting image obtained at the bottom of a cut hole on sinking a cutting device according to the invention with partly upwardly pivoted cutting wheels 1, 2. Between the two cutting wheels 1, 2 is formed a conical projection 80 on the cut hole bottom. This conical projection 80 is worked off by the front sides of the inner individual cutting wheels 11', 12'.

The invention claimed is:

1. Cutting device for sinking a cut hole in the ground in a sinking direction, comprising:

a support having a support rotation axis, at least two cutting wheels mounted on the support in rotary manner about respective cutting wheel rotation axes, wherein:

(a) the cutting wheels are arranged such that on rotation of the support, the cutting wheels describe a circular path along which they remove soil, and (b) the cutting wheel rotation axis of at least one cutting wheel has an offset with respect to the support rotation axis, at least one cutting wheel drive means for the rotary driving of the cutting wheels on the support about the respective cutting wheel axes for removing soil through the rotation of the cutting wheels about the respective cutting wheel rotation axes, and support drive means for simultaneously rotating the support together with the cutting wheels about the support rotation axis approximately parallel to the sinking direction in order to describe a circular path with the cutting wheels to remove soil, wherein the angle between the cutting wheel rotation axes and the support rotation axis is approximately 90°.

2. Cutting device according to claim 1, further comprising pivoting means for pivoting at least one of the cutting wheels.

3. Cutting device according to claim 1, further comprising a tube linkage, wherein the support is located terminally on the tube linkage.

4. Cutting device according to claim 3, further comprising tensioning means for fixing the tube linkage in a support tube, wherein the tube linkage is axially extendible for driving the support.

5. Cutting device according to claim 3, wherein the support drive means is located at least one of: (a) between the tube linkage and the support and (b) in an upper area of the tube linkage.

6. Cutting device according to claim 3, further comprising:

guide means provided on the tube linkage for supporting the tube linkage on a hole wall.

7. Cutting device according to claim 6, wherein the guide means is a guide ring, for supporting the tube linkage on a hole wall.

8. Cutting device according to claim 3, further comprising advancing means for exerting a superimposed load force on the tube linkage for advancing the support with the cutting wheels in the sinking direction in the ground.

9. Cutting device according to claim 1, further comprising guide means provided on the support for supporting the support on a hole wall.

10. Cutting device according to claim 9, wherein the guide means is constructed in diameter-adjustable manner.

11. Cutting device according to claim 9, wherein the guide means is a guide ring, for supporting the support on a hole wall.

12. Cutting device according to claim 1, further comprising cutting wheel offset drive means for modifying the offset.

13. Cutting device according to claim 1, further comprising a plurality of bearing brackets pivotably mounted on the support, wherein each of the cutting wheels are constructed as two individual cutting wheels and each two individual cutting wheels are mounted on a respective one of the bearing brackets.

14. Cutting device according to claim 1, wherein the cutting wheels are at least one of circumferentially and frontally provided with cutting tools.

15. Cutting device according to claim 1, further comprising pivoting means for pivoting at least one of the cutting wheels upwardly on the support.

16. Cutting device according to claim 1, wherein the weight of the cutting device provides means for advancing the support with the cutting wheels in the sinking direction in the ground.

17. Method for producing a cut hole in the ground with a cutting device, wherein the device has:

a support having a support rotation axis, at least two cutting wheels mounted on the support in rotary manner about respective cutting wheel rotation axes, wherein:

(a) the cutting wheels are arranged such that on rotation of the support, the cutting wheels describe a circular path along which they remove soil, and (b) the cutting wheel rotation axis of at least one cutting wheel has an offset with respect to the support rotation axis, at least one cutting wheel drive means for the rotary driving of the cutting wheels on the support for removing soil through the rotation of the cutting wheels about the respective cutting wheel rotation axes, and support drive means for rotating the support together with the cutting wheels about a the support rotation axis approximately parallel to the sinking direction, wherein the angle between the cutting wheel rotation axes and the support rotation axis is approximately 90°, the method comprising the steps of:

rotating the at least two cutting wheels on the support about the respective cutting wheel axes using the cutting wheel drive means, advancing the support with the cutting wheels in the sinking direction in the ground, and simultaneously rotating the support together with the cutting wheels using the support drive means to describe a circular path with the cutting wheels to remove soil.

18. Method according to claim 17, wherein during the step of rotating the support, a rotation direction of the support about the support rotation axis is alternately changed.

19. Method according to claim 17, further comprising the step of pivoting at least one of the cutting wheels on the support.

20. Method according to claim 17, further comprising the step of pivoting at least one of the cutting wheels up on the support.

21. Method according to claim 17, further comprising the step of pivoting at least one of the cutting wheels up on the support as a function of a rotation angle of the support about the support rotation axis.

* * * * *